US006944408B2

(12) United States Patent
Holzner

(10) Patent No.: US 6,944,408 B2
(45) Date of Patent: Sep. 13, 2005

(54) CONTROL DEVICE AND METHOD FOR MONITORING WEAR PARTS FOR PRINTERS AND COPIERS

(75) Inventor: Bernhard Holzner, Dorfen (DE)

(73) Assignee: Oce Printing Systems GmbH, Poing (DE)

( * ) Notice: Subject to any disclaimer, the term of this patent is extended or adjusted under 35 U.S.C. 154(b) by 11 days.

(21) Appl. No.: 10/626,243

(22) Filed: Jul. 24, 2003

(65) Prior Publication Data

US 2004/0190917 A1 Sep. 30, 2004

(30) Foreign Application Priority Data

Jul. 25, 2002 (DE) ..... 102 33 891

(51) Int. Cl.[7] ..... G03G 15/00; G03G 15/08; G03G 15/20; G03G 21/00

(52) U.S. Cl. ..... 399/24; 399/25; 399/26; 399/27; 399/31; 399/33; 399/34; 399/35

(58) Field of Search ..... 399/24–27, 31, 399/33–35, 80

(56) References Cited

U.S. PATENT DOCUMENTS

| | | | | |
|---|---|---|---|---|
| 4,587,532 A | | 5/1986 | Asano | |
| 4,591,884 A | | 5/1986 | Miyamoto et al. | |
| 5,258,809 A | | 11/1993 | Wiedemer | |
| 5,682,140 A | | 10/1997 | Christensen et al. | |
| 6,212,357 B1 | | 4/2001 | Boehmer et al. | |
| 6,295,423 B1 | * | 9/2001 | Haines et al. | 399/24 |
| 6,625,403 B2 | * | 9/2003 | Carling et al. | 399/24 |

FOREIGN PATENT DOCUMENTS

| | | |
|---|---|---|
| DE | 1 280 605 | 7/1964 |
| DE | 34 07 847 A1 | 9/1984 |
| DE | 34 16 252 A1 | 11/1984 |
| DE | 38 36 890 A1 | 5/1989 |
| DE | 689 28 579 T2 | 6/1998 |
| DE | 695 23 466 T2 | 6/2002 |
| DE | 696 18 931 T2 | 6/2002 |
| EP | 0 104 022 A2 | 3/1984 |
| EP | 0 658 824 A2 | 6/1989 |
| EP | 0 785 479 A2 | 7/1997 |
| WO | WO 91/13386 | 9/1991 |
| WO | WO 98/18052 | 4/1998 |

* cited by examiner

*Primary Examiner*—William J. Royer
(74) *Attorney, Agent, or Firm*—Schiff Hardin LLP

(57) ABSTRACT

A control device and a method for monitoring wear parts for printers and copiers is provided. The control device includes a counter device with which the replacement intervals or, respectively, the maintenance intervals for individual wear parts are monitored. The replacement and maintenance intervals can be individually set, so that they can be matched to the respective use conditions of the printer.

7 Claims, 4 Drawing Sheets

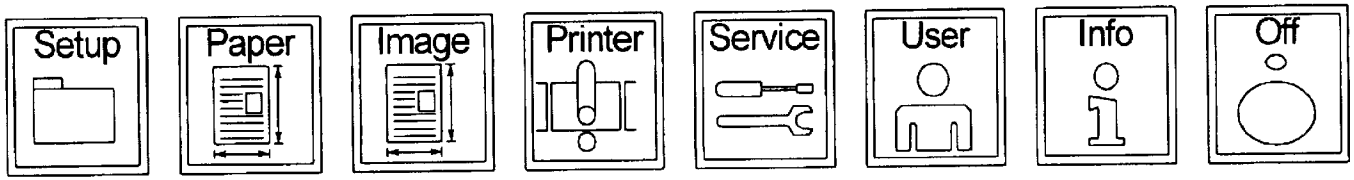

| | | | | |
|---|---|---|---|---|
| Cleaning roller/band upper printing unit | 213400 | (71 %) | 0% | 100% |
| Cleaning roller/band lower printing unit | 272800 | (90 %) | 0% | 100% |
| Pressure foils upper printing unit | 600000 | (100 %) | 0% | 100% |
| Pressure films lower printing unit | 0 | (0 %) | 0% | 100% |
| Oil roller upper printing unit | 600000 | (100 %) | 0% | 100% |
| Oil roller lower printing unit | 600000 | (100 %) | 0% | 100% |
| Feed system A | 123000 | (21 %) | 0% | 100% |
| Feed system B | 0 | (0 %) | 0% | 100% |
| Feed system C | 0 | (0 %) | 0% | 100% |
| Feed system D | 0 | (0 %) | 0% | 100% |
| Paddle A operator side | 513500 | (85 %) | 0% | 100% |
| Paddle A drive side | 600000 | (100 %) | 0% | 100% |
| Paddle B operator side | 600000 | (100 %) | 0% | 100% |
| Paddle B operator side | 600000 | (100 %) | 0% | 100% |
| Maintenance | 51100 | (11 %) | 0% | 100% |

*FIG. 4*

CONTROL DEVICE AND METHOD FOR MONITORING WEAR PARTS FOR PRINTERS AND COPIERS

BACKGROUND OF THE INVENTION

1. Field of the Invention

The present invention is in general directed to a control device and to a method for monitoring wear parts for printers and copiers. The invention is in particular provided for electrophotographically working printers and copiers.

2. Description of the Related Art

Electrophotographic printers are disclosed, for example, by German Patent Document DE 34 16 252 A1, European Patent Document EP 0 104 022 A2, German Letters Patent 1,280,605, German Patent Document DE 34 07 847 A1, and Published International Applications WO 91/13386 or WO 98/18052.

Published International Application WO 98/18052 discloses a printer with two identical printing units to which page-shaped material to be printed is supplied via a common input section. The printed material is output via a common output section.

Such printers and copiers are provided with a counting device for counting the number of printed sheets. Respective thresholds are stored in the control device for each wear part. An alarm signal is output when the number of printed sheets reaches a threshold, so that the corresponding wear part can be replaced. This prevents the printer or copier from continuing to operate with parts that are no longer suitable, which could result in the occurrence of malfunctions in the printing operation that could lead to a complete standstill of printing operations.

This monitoring of the individual wear parts assures a continuous operation of the printer or copier.

Printers and copiers, however, are often utilized in different environments, for example in climate-controlled rooms or in cool basement rooms or hot offices, and different users stress the printers and copiers in different ways. Thus, there are users who essentially print only invoicing texts having relatively little text per page. Other users, by contrast, print a great deal of text and/or images on a page and thus make significantly more intensive use of the fixing unit per page than a user who prints only little text.

SUMMARY OF THE INVENTION

The present invention provides a control device and a method for monitoring wear parts for printers and copiers in order to reduce the consumer costs of the printer or copier.

This is achieved by a control device for monitoring wear parts for printers and copiers having a counter device for counting the number of printed sheets; a memory device for storing initial values and thresholds for the individual wear parts, whereby the counter device counts the number of printed sheets in a counting direction toward the thresholds proceeding from the initial values; and an alarm device for comparing the number of printed sheets to the thresholds and for outputting an alarm signal when a predefined threshold is exceeded.

The control device is provided with a setting function for individual setting of the initial values and/or thresholds for the individual wear parts.

As a result, it is possible to individually set the replacement and maintenance intervals for the individual wear parts and to thus adapt them to different applications or environmental conditions. Thus, wear parts that are subject to less wear due to certain conditions can be retained longer in the printer or copier, and wear parts that are correspondingly more heavily used can be replaced correspondingly faster. This results in a considerable reduction in the operating costs without deteriorating the dependability of the printer or copier.

BRIEF DESCRIPTION OF THE DRAWINGS

The invention is explained in greater detail below on the basis of the exemplary embodiments shown in the drawing.

FIG. 4 is a screen shot of the picture screen display of the printer shown in FIG. 3, shown in a magnified, separate presentation.

DETAILED DESCRIPTION OF THE PREFERRED EMBODIMENTS

Figure 3:
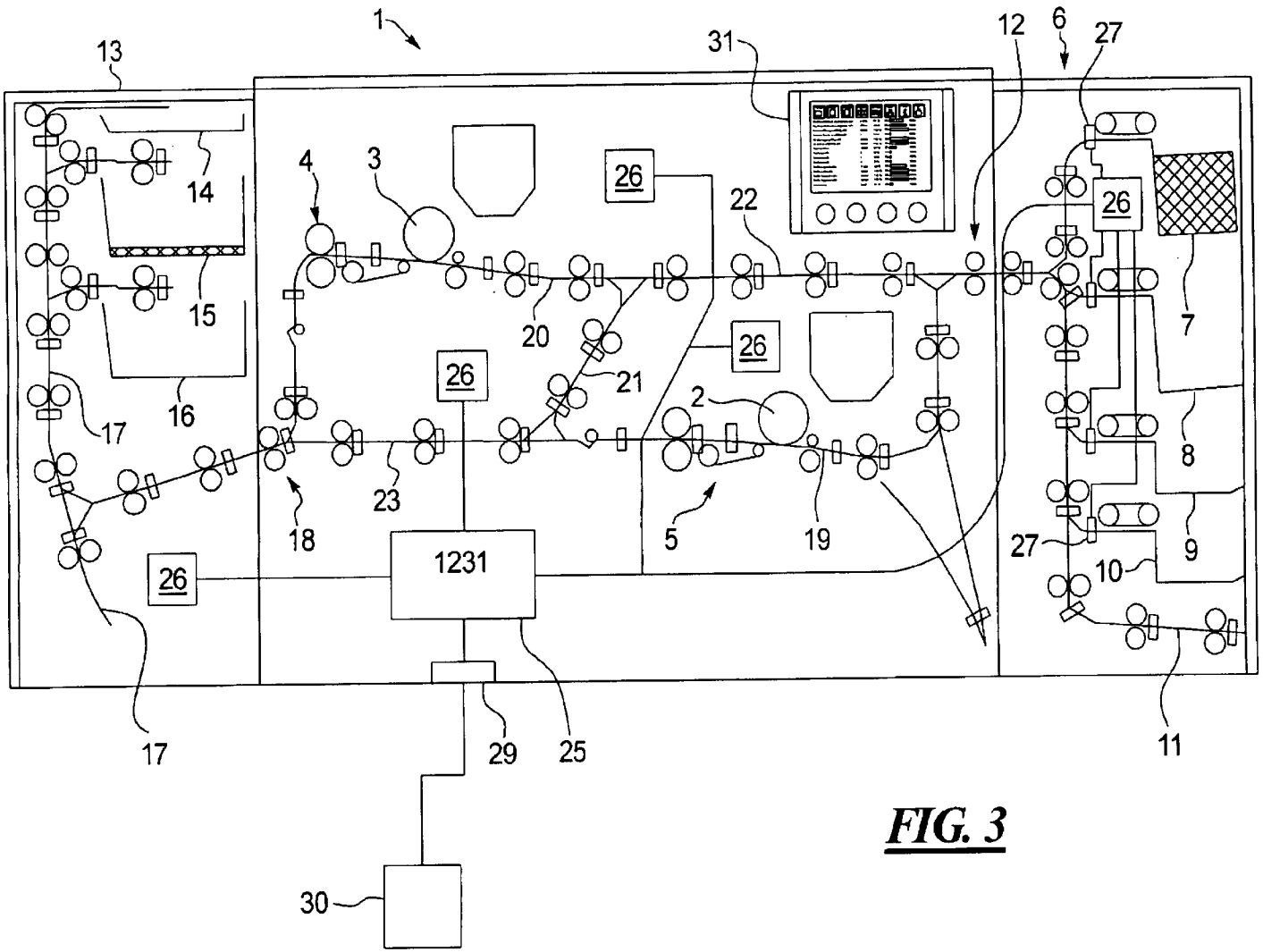
FIG. 3 is a side cross section of a printer having an inventive control device, shown schematically.

FIG. 3 shows a high-performance printer 1 that serves for fast printing of sheets of paper. The high-performance printer 1 contains a first, lower printing unit 2 as well as a second, upper printing unit 3. Both printing units 2 and 3 work according to the known electrographic process and with the same transfer printing speed. The printing units 2 and 3 are followed by fixing devices 4 and 5 that are schematically shown in FIG. 3. A paper input 6 is connected to the high-performance printer 1, the paper input 6 containing a plurality of supply containers 7–10 with single sheets as well as an external paper input channel 11 via which single sheets can be delivered from the outside via preceding, optional input units or, respectively, a paper pre-processor. Individual sheets are supplied to an input section 12 via a transport channel. A paper output 13 containing a plurality of output containers 14–16 is connected to the high-performance printer 1 at the output side. Two output channels 17 are also provided via which the printer sheets can be output to stations that process single sheets. The high-performance printer 1 outputs the printed single sheets via an output section 18.

Transport paths for the transport of the individual sheets are arranged in the inside of the high-performance printer, the various operating modes of the high-performance printer being realized therewith. The printing units 2 and 3 have transfer printing transport paths 19 and 20 respectively allocated to them that are respectively set by drives such that the supplied single sheets have their transfer printing velocity at the printing units 2 and 3. The two transfer printing transport paths 19 and 20 are connected to one another via a connecting channel 21. The transport path around the first printing unit 2 is supplemented to form a ring by means of a delivery channel 22 via which single sheets can also be supplied from the input section 12 to the second transfer printing transport path 20. The transport path for the second printing unit 3 is similarly augmented to form a ring by means of a discharge channel 23 via which single sheets printed by the first printing unit 2 can be delivered to the output section 18.

Various operating modes of the high-performance printer 1 can be realized with the arrangement shown in FIG. 3. This arrangement corresponds to the arrangement disclosed by the International Patent Application WO 98/18052. Published Application No. WO 98/18052 is therefore incorporated by reference into the present application. In particular, the individual operating modes of this printer, particularly for simplex printing and duplex printing, are explained in greater detail in Application No. WO 98/18052.

This high-performance printer 1 is controlled by a central control device 25 that is also referred to as a main module. The central control device 25 is connected to a plurality of sub-controllers 26 that are also referred to as sub-modules. The sub-controllers 26 control the units that are respectively allocated to them such as, for example, printing units 2 and 3, the conveyor devices, shunts, fixing devices, 4 and 5, and the like. One of the sub-controllers 26 is arranged in the paper input 6. Respective sheet counting sensors 27 that are connected to the sub-controller 26 of the paper input 6 are arranged adjacent to the supply containers 7–10 of the paper input 6. The signals generated by the sensors 27 are forwarded via the sub-controller 26 to the central control device 25.

A counter device is implemented at the central control device 25. This counter device is realized by a software module that is stored in a data memory of the central control device 25 and executed by the central control device 25. The counter device comprises a separate counter for each wear part. In the present exemplary embodiment, the counters are realized as deincrementing counters, i.e. they respectively reduce the value of the counter by 1 proceeding from an initial value or, respectively, a start value when a DIN A4 sheet is printed. The present application makes reference to printing DIN A4 pages, but of course other sizes of printed pages are also possible, including 8.5 inch by 11 inch or letter size and 8.5 inch by 14 inch or legal size pages.

Figure 1:
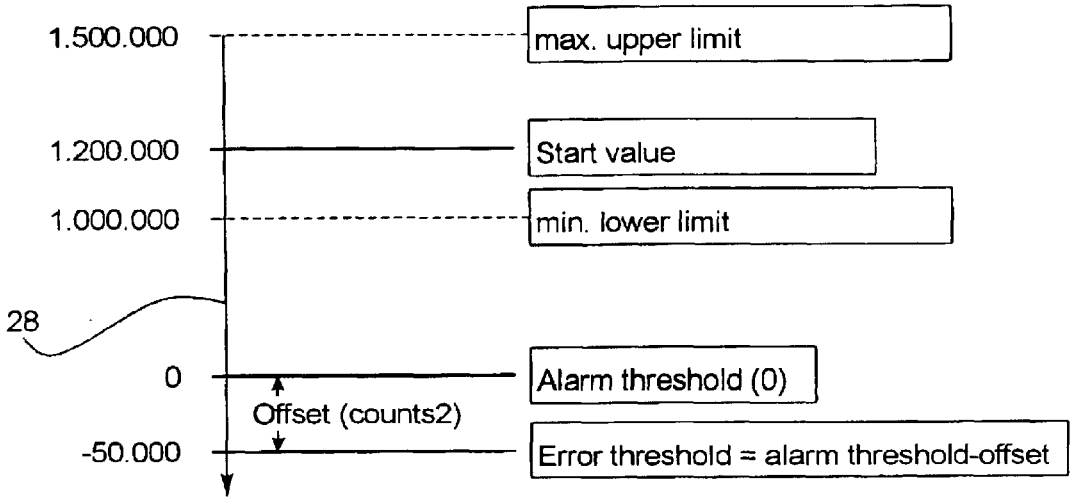
FIG. 1 is a graph showing an initial value and thresholds for a counter device that counts down, shown schematically.

With reference to a vertically downwardly directed count arrow 28, FIG. 1 schematically shows the initial values and thresholds of a counter for a specific fixing drum. The start value for this fixing drum amounts to 1,200,000. This start value is an empirically determined value that indicates the number of printed DIN A4 pages after which the corresponding wear part (here: the fixing drum) must be replaced. Inventively, an arbitrary, other value within a range of tolerance for maintenance that is limited by a minimum lower limit and a maximum upper limit can also be selected instead of the empirically determined start value. An interface 29 connected to the central control device 25 is provided for this purpose, a computer 30 being connectible to the interface 29. A software module is stored on the computer 30 that can communicate with the software module stored in the central control device 25 and that can identify the user of the computer 30 as being authorized to change the initial value. This ensues by means of a specific authorization code that is transmitted from the computer 30 to the central control device 25. The setting function for the individual setting of the initial value is only enabled after receipt of this authorization code such that the user at the computer 30 can modify the initial value within the predefined range of tolerance for maintenance.

The counter counts from the initial value in the direction toward a first threshold, the alarm threshold, whose value is zero in the present exemplary embodiment. An alarm signal is output when the alarm threshold is reached, the alarm signal prompting the user to replace the corresponding wear part.

A second threshold—the error threshold—is offset by a specific offset with respect to the alarm threshold. The offset amounts to −50,000 in the present exemplary embodiment. The operation of the printer is automatically halted when the counter reaches the error threshold.

Typical wear parts in a printer or copier for which such a counter is provided are fixing drums, pressure rollers, oil rollers, developer units, developer mixes, corotrons, cleaning flaps and other consumables such as, for example, fixing oil.

Figure 5:
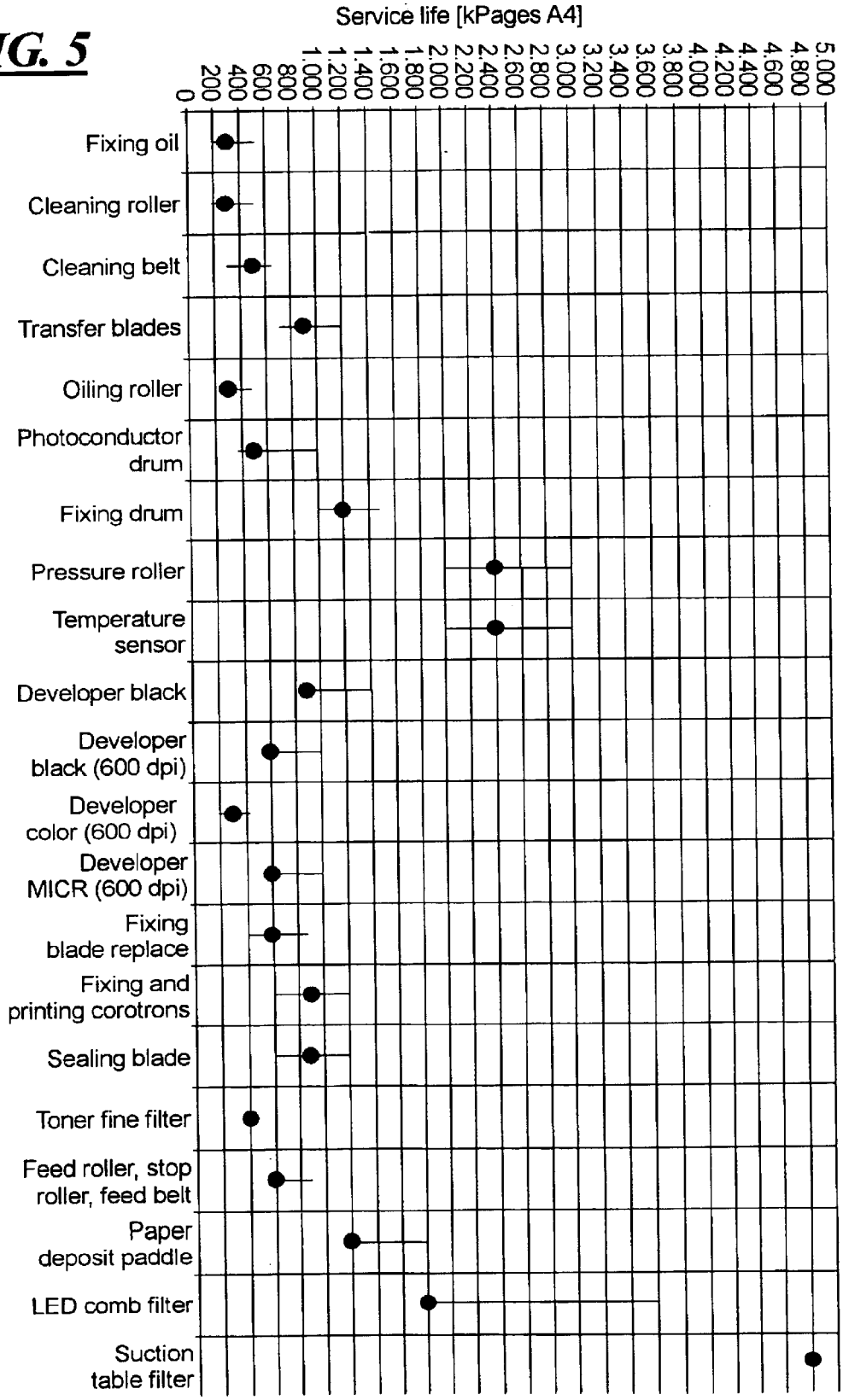
FIG. 5 is a graph showing typical ranges of tolerance for maintenance.

FIG. 5 shows a diagram in which tolerance ranges for maintenance are presented for various parts and consumables. These tolerance ranges are illustrated by vertically proceeding lines whose ends represent the lower limit and upper limit of the tolerance ranges for maintenance. The large dots within the lines represent the start values that have been empirically determined and specified. In traditional control devices, the counters for the individual elements and consumables were always fixed at these start values. With the present invention, by contrast, the initial values can be varied within the respective tolerance range for maintenance. Within the scope of the present invention, of course, it is also possible to not provide any tolerance ranges for maintenance for some individual elements, as indicated here, for example, for the fine toner filter and the suction table filter.

The printer 1 comprises a display device 31 in the form of an integrated picture screen at which the counter reading of the individual counters can be displayed. A corresponding picture screen display is shown magnified in FIG. 4. This picture screen display comprises four columns. The names of the respective wear parts are indicated in the first column. The remaining number of printable DIN A4 pages until the next replacement of the respective wear part is indicated in the second column. The third column indicates as a percentage the amount of the counter reading indicated in the second column compared to the difference between the alarm threshold and the initial value, being respectively indicated in parenthesis. This percentage thus indicates what amount of the maintenance or, respectively, replacement interval is still present. This amount is graphically presented with horizontal bars in the fourth column.

The values shown in the display are respectively counted down to zero. In the illustrated exemplary embodiment, thus, the pressure foils of the lower printing unit, the feed system B, the feed system C and the feed system D must be replaced soon, in contrast whereto the pressure foils of the upper printing unit, the oil roller of the upper and lower printing unity, the paddle A, the paddle B at the operator side and at the drive side have just been replaced since the maintenance interval here has already been completely used up.

Figure 2:
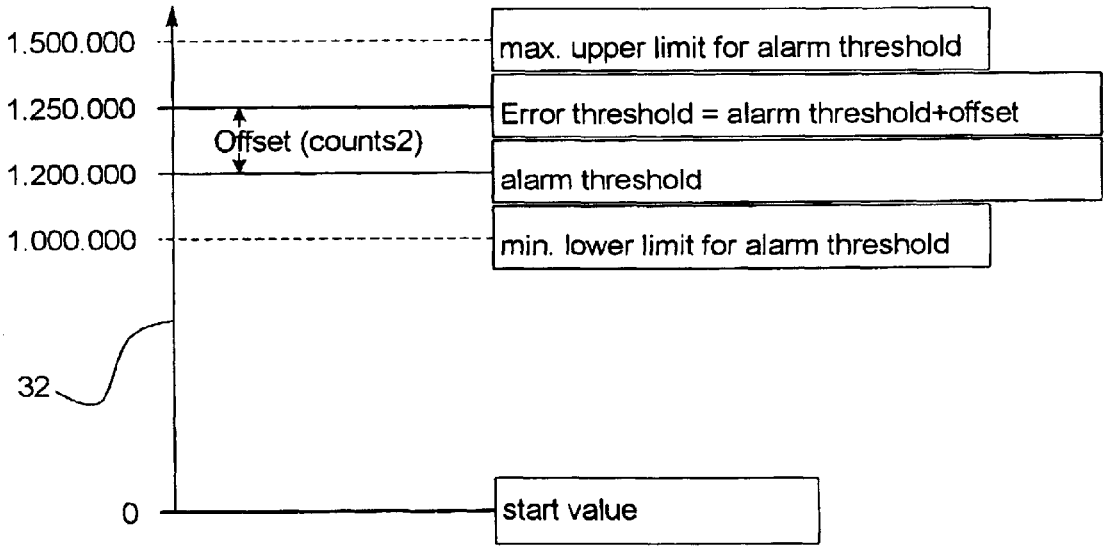
FIG. 2 is a graph showing an initial value and thresholds for a counter device that counts up, shown schematically.

In the scope of the invention, of course, it is also possible to employ an incrementing counter device instead of a deincrementing counter device. FIG. 2 shows a count line 32 with a start value and the corresponding thresholds for a counter device that counts up. A start value of zero is thereby always defined as an initial value, the counter being set thereto when the corresponding wear part is replaced. As in the above exemplary embodiment, an alarm threshold can be freely selected within a tolerance range for maintenance that lies between a minimum lower limit of 1,000,000 and a maximum upper limit of 1,500,000. The typical replacement value that is empirically determined and specified lies at 1,2000,000. This is the standard alarm threshold when no modification has been undertaken by a user. An offset of 50,000 is provided with respect to the alarm threshold, this yielding the error threshold (1,250,000 here).

After the replacement of a corresponding wear part, the value of the counter is incremented by one with every printed DIN A4 page. An alarm signal is output when the alarm threshold is reached, and the printing operation is automatically halted when the error threshold is reached.

Regardless of whether an incrementing or deincrementing counter device is employed, an authorized service technician or other authorized user can individually modify the individual replacement or, respectively, maintenance intervals for the wear parts, so that certain wear parts that are subjected to less stress by a certain user of the printer are replaced after longer intervals, in contrast whereto other wear parts that are subjected to greater stress are replaced after shorter intervals. In other words, the service technician or other authorized personnel changes the replacement or maintenance intervals monitored by the device depending on conditions observed by the technician, i.e. environmental conditions, use conditions, wear conditions, and the like. The changes possible are within the permitted range, as specified for example by the manufacturer. The technician may make the changes via a command or menu selection shown at the display device 31. For example, the technician may increase or decrease the replacement or maintenance interval for each individual part using increase or decrease controls, respectively, depending on the observed conditions.

The invention can be summarized in brief in the following way:

The invention is directed to a control device and to a method for monitoring wear parts for printers and copiers. The inventive control device comprises a counter device with which the replacement intervals or, respectively, the maintenance intervals for individual wear parts can be monitored. The invention is characterized in that the replacement and maintenance intervals can be individually set, so that they can be matched to the respective use conditions of the printer.

Although other modifications and changes may be suggested by those skilled in the art, it is the intention of the inventors to embody within the patent warranted hereon all changes and modifications as reasonably and properly come within the scope of their contribution to the art.

I claim:

1. A control device for monitoring wear parts for a printer or copier, comprising:

a counter device connected to the printer or copier so as to count a number of sheets printed by the printer or copier;

a memory device for storing initial values and thresholds for individual wear parts of the printer or copier;

said counter device starting to count the number of the sheets printed at the initial values and counting in a direction toward the thresholds;

an alarm device connected to compare a number of printed sheets to the thresholds and operable to output an alarm signal when a predefined threshold is exceeded;

a control device being fashioned with a setting function for individual setting of at least one of the initial values and the thresholds for the individual wear parts;

a separate setting device that is connectable to said control device to enable said setting function, said setting function being enabled only with said separate setting device, wherein said setting function can only be called with an authorization code.

2. A control device for monitoring wear parts for a printer or copier, comprising:

a counter device connected to the printer or copier so as to count a number of sheets printed by the printer or copier;

a memory device for storing initial values and thresholds for individual wear parts of the printer or copier;

said counter device starting to count the number of the sheets printed at the initial values and counting in a direction toward the thresholds;

an alarm device connected to compare a number of printed sheets to the thresholds and operable to output an alarm signal when a predefined threshold is exceeded; and a control device being fashioned with a setting function for individual setting of at least one of the initial values and the thresholds for the individual wear parts, wherein said setting function can only be called with an authorization code.

3. A control device according to claim 2, wherein said counter device is a deincrementing counter and the initial values are adjustable.

4. A control device according to claim 2, wherein said counter device is an incrementing counter and the initial values are reset to zero upon introduction of a new wear part and the thresholds are individually set.

5. A control device according to claim 2, wherein at least one of the initial values and thresholds for the individual wear parts are only set within predetermined tolerance ranges for maintenance.

6. A control device according to claim 5, wherein said predetermined tolerance ranges for maintenance amount to about 30% through 100% of empirically determined and specified replacement values.

7. A method for monitoring wear parts of a printer or copier, comprising the following steps;

counting a number of printed sheets by said printer or copier with a counter device;

storing initial values and thresholds for individual wear parts of said printer or copier;

said counting step counting a number of the printed sheets in a direction toward the thresholds starting from the initial values;

outputting an alarm signal when a predefined threshold was crossed;

individually setting at least one of the initial values and the thresholds for the individual wear parts; and requiring an authorization code for acceptance of said step of setting at least one of the initial values and the thresholds.

* * * * *